US005315744A

United States Patent [19]

Denham et al.

[11] Patent Number: 5,315,744

[45] Date of Patent: May 31, 1994

[54] METHOD AND APPARATUS FOR PULL-THROUGH BLIND INSTALLATION OF A TUBULAR MEMBER

[75] Inventors: Keith Denham, Welwyn Garden City; Michael Miles, Stevenage, both of United Kingdom

[73] Assignee: Avdel Systems Limited, Welwyn Garden City, United Kingdom

[21] Appl. No.: 818,456

[22] Filed: Jan. 3, 1992

Related U.S. Application Data

[63] Continuation of Ser. No. 493,797, Mar. 15, 1990, abandoned.

[30] Foreign Application Priority Data

Mar. 17, 1989 [GB] United Kingdom ..... 8906231

[51] Int. Cl.[5] ..... B23P 11/00

[52] U.S. Cl. ..... 29/243.53; 29/252; 29/243.523; 72/453.17; 72/391.4

[58] Field of Search ..... 29/243.5, 243.53, 243.52, 29/243.54, 252, 243.521, 243.523; 72/453.17, 391.4

[56] References Cited

U.S. PATENT DOCUMENTS

| | | | |
|---|---|---|---|
| 3,828,603 | 8/1974 | Sheffield et al. | 72/391 |
| 3,832,880 | 9/1974 | Charman | 72/391 |
| 4,368,838 | 1/1983 | Sheffield et al. | 227/55 |
| 4,386,515 | 6/1983 | Starke | 72/391 |
| 4,744,238 | 5/1988 | Halbert | 29/243.53 |
| 4,750,347 | 6/1988 | Saarinen | 29/243.53 |
| 4,872,332 | 10/1989 | Potzas | 72/393 |

*Primary Examiner*—Bruce M. Kisliuk
*Assistant Examiner*—Eileen P. Morgan
*Attorney, Agent, or Firm*—Oblon, Spivak, McClelland, Maier & Neustadt

[57] ABSTRACT

An apparatus for the pull-through blind installation of a headless tubular ferrule in a hole in a workpiece at a position therealong spaced from the nearer face of the workpiece includes an annular anvil for supporting the ferrule inside the workpiece hole; anvil supporting means for initially supporting the anvil at a position inside the workpiece hole; a mandrel having a stem extending through the anvil aperture; and an enlarged head. The apparatus further includes a pneumatically-operated retraction device for retracting the mandrel stem through the anvil aperture thereby to draw the mandrel head into the adjacent part of the bore of the ferrule while the ferrule is supported inside the workpiece hole by the annular anvil, thereby to enlarge the part of the ferrule more remote from the anvil into engagement with the workpiece; and a pneumatically-operated withdrawal device for withdrawing the anvil away from the ferrule to allow the mandrel head to be withdrawn completely through the remainder of the bore of the ferrule, to complete installation of the ferrule.

7 Claims, 8 Drawing Sheets

METHOD AND APPARATUS FOR PULL-THROUGH BLIND INSTALLATION OF A TUBULAR MEMBER

This application is a continuation of application Ser. No. 07/493,797, filed on Mar. 15, 1990, now abandoned.

BACKGROUND OF THE INVENTION

Blind installation of a tubular member in a workpiece is installation by access to one side only of the workpiece. One method of blind installation is the so-called pull-through method, which essentially comprises pulling an oversize mandrel head through the bore of the tubular member. In use, the tubular member is inserted in a hole in a workpiece in which the outside of the member is a fairly close radial fit. It is installed by pulling through the bore the head of a mandrel, the mandrel head having a greater external diameter than at least part of through the anvil aperture; and an enlarged head; the bore (the term "diameter" is used because the tubular bore and the mandrel head are usually both circular in cross-section, although not necessarily so). The passage of the mandrel head through the bore thus radially expands at least part of the bore and the corresponding part of the exterior of the tubular member, thereby deforming the tubular member into engagement with the workpiece in which it is inserted. The remote end of the tubular member usually protrudes from the rear face of the workpiece and is expanded to form a blind head. The mandrel is removed completely from the bore and forms no part of the installed member. Examples of such tubular members are the blind tubular rivets commercially available in many countries of the world under the Registered Trade Marks CHOBERT and BRIV.

When the head of the mandrel is pulled through a tubular member, the member must be supported axially against the axial force exerted on it by the mandrel head. This is done by means of an annular anvil, the annular face of which contacts the end of the tubular member, the mandrel stem extending through the aperture in the centre of the annular anvil. Since the tubular member is in contact with the anvil, and the mandrel head has to be pulled completely through the bore, the anvil aperture has to be of a sufficient diameter to allow the head of the mandrel to enter it and pass through it. Thus the diameter of the anvil aperture is larger than the diameter of the bore of the tubular member (or at least of that part of the bore which is radially expanded by the mandrel head).

Tubular members of the blind tubular rivet type available under the Registered Trade Marks CHOBERT and BRIV have an enlarged preformed head at one end, which head contacts the accessible face of the workpiece. In use, the tubular member is axially supported as aforesaid by contact of the anvil of the installation apparatus (usually referred to as a placing tool) with the preformed head of the member. The annular anvil can support the member by contact with the enlarged preformed head outside the workpiece, around an annular zone surrounding the anvil aperture, which zone may be spaced radially outwardly from the bore and provides no restrictions on making the anvil aperture sufficiently large to accommodate the mandrel head.

Pull-through blind installation apparatus operating in this way has been well known for many years in the art of mechanical assembly, for installing the aforementioned blind tubular rivets available under the Registered Trade Marks CHOBERT and BRIV.

In this prior art apparatus, the practice has been for a column of rivets to be loaded onto the mandrel, behind the anvil. In order to feed the next rivet along the mandrel stem to the front of the anvil, the anvil is split longitudinally into two parts along a plane containing the mandrel axis. These two parts are referred to as "jaws", since their shape and movement resemble those of a pair of jaws, although these anvil parts do not usually perform any gripping operation. When the mandrel head has been withdrawn through the anvil aperture, the column of rivets on the mandrel stem is urged forward so that the leading rivet contacts the mandrel head. The mandrel head and the leading rivet are urged forward so that they force the anvil jaws apart and allow the leading rivet through the thus enlarged anvil aperture. The anvil jaws then close behind the head of the leading rivet and around its shank, in the axial space behind that head and in front of the head of the next succeeding rivet, ready to provide axial support to the leading rivet when it is placed.

There has now arisen a requirement to install a tubular member in the form of a tubular ferrule, having no preformed enlarged head, with the nearer end of the ferrule at a distance inside the hole in the workpiece. The ferrule has a relatively thin wall, and in order to axially support the ferrule against the passage of the mandrel head as explained above, it is necessary for the anvil to support the end of the ferrule wall across substantially the full thickness thereof. Thus the anvil aperture can be no larger in diameter than the ferrule bore. Consequently the mandrel head (or at least that part of it which is of the largest diameter and which is effective to expand the ferrule) cannot pass into and through the anvil aperture. Since the anvil is inside the workpiece hole, there is no room to open the jaws as has been the practice in the prior art. Furthermore, since the tubular ferrule, when in the installation apparatus before installation, is headless and of uniform external diameter, there is no head on the leading ferrule behind which the anvil jaws could close, as described in the prior art apparatus described above. Thus it would not be possible to reliably separate the leading ferrule from the following one as the leading ferrule is fed through the anvil jaws, so that the split jaws could not be arranged to close behind the leading ferrule.

These restrictions present problems, which the present invention seeks to overcome.

SUMMARY OF THE INVENTION

The invention provides, in one of its aspects, a method of pull-through blind installation of a tubular member in a hole in a workpiece, which method comprises:

positioning the tubular member on the stem of a pull-through mandrel which has a head at least part of which is of larger diameter than at least part of the bore of the tubular member;

inserting the mandrel and tubular member into a hole in a workpiece in which the tubular member is to be installed, with the nearer end of the tubular member (i.e. the end remote from the mandrel head) inside the workpiece hole and at a distance from the nearer face thereof;

supporting the nearer end of the tubular member by means of an annular anvil face which overlies substantially all of the nearer end of the tubular member;

drawing the mandrel head through part of the bore of the tubular member thereby to expand at least the more remote part of the tubular member into engagement with the workpiece;

and withdrawing the annular anvil from the workpiece hole to allow the mandrel head to pass completely through the remainder of the bore of the tubular member, the tubular member then being axially supported by its aforesaid engagement with the workpiece.

The invention also provides apparatus for the pull-through blind installation of a tubular member in a hole in a workpiece at a position therealong spaced from the nearer face of the workpiece, which apparatus comprises:

an annular anvil for supporting a tubular member inside the workpiece hole;

anvil supporting means for initially supporting the anvil at a position inside the workpiece hole;

a mandrel having a stem extending through the anvil aperture and an enlarged head;

retraction means for retracting the mandrel stem through the anvil aperture thereby to draw the mandrel head into the adjacent part of the bore of the tubular member while the tubular member is supported inside the workpiece hole by the annular anvil, thereby to enlarge at least the part of the tubular member more remote from the anvil into engagement with the workpiece;

and means for withdrawing the anvil away from the tubular member to allow the mandrel head to be withdrawn completely through the remainder of the bore of the tubular member.

Further features of the invention will be apparent from the following description and the appended claims.

BRIEF DESCRIPTION OF THE DRAWINGS

A specific embodiment of the invention, in the form of a pull-through installation apparatus, and methods of pull-through installation, will now be described by way of example and with reference to the accompanying drawings, in which.

DESCRIPTION OF THE PREFERRED EMBODIMENTS

Figure 1:
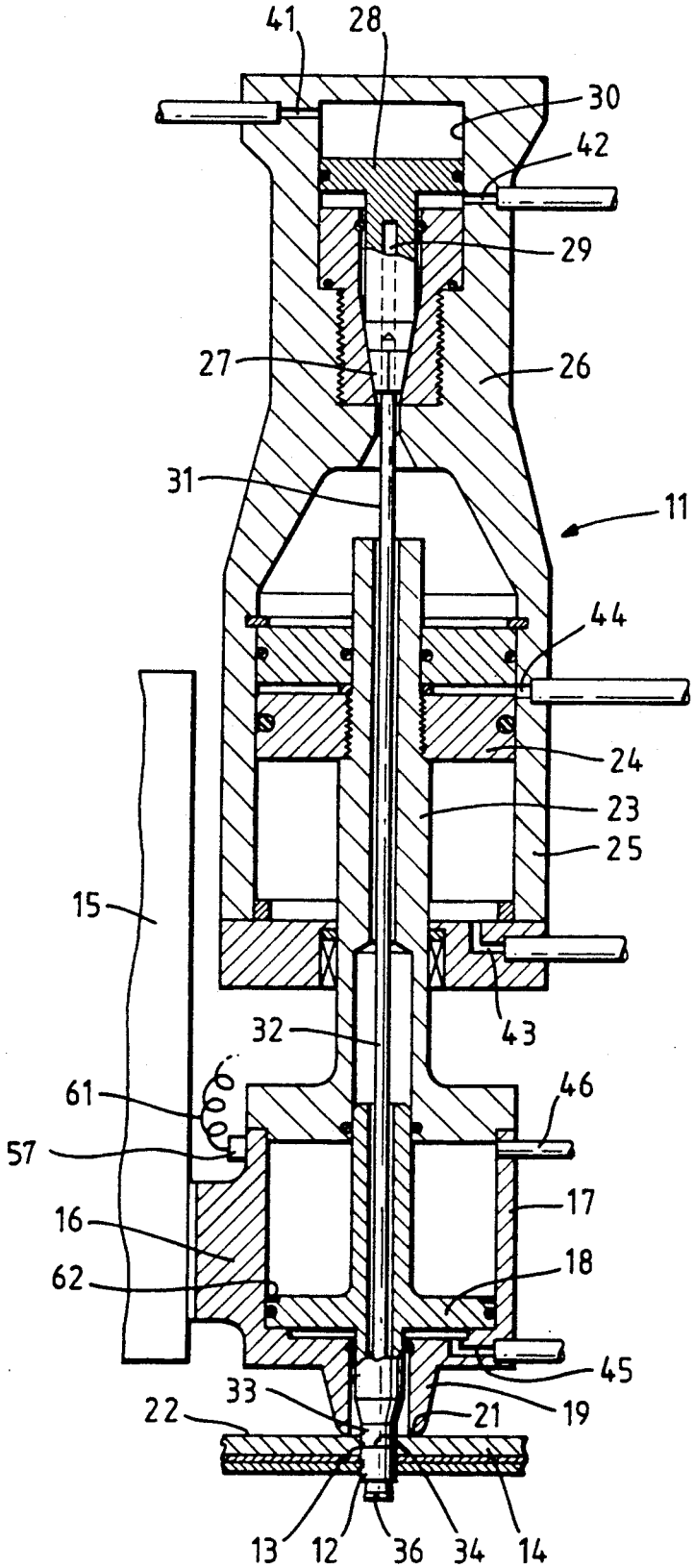
FIG. 1 is an axial longitudinal section through a pneumatically operated apparatus for pull-through blind installation of a tubular ferrule in a workpiece hole.

The installation apparatus illustrated in FIG. 1 is in the form of a pneumatically operated tool 11 for installing a tubular member in the form of an initially headless ferrule 12. The ferrule is to be installed in a hole 13 in a workpiece 14 which, in this example, comprises a number of sheets of different materials.

The tool is supported on a frame 15 so that it can be brought into the correct relationship with the workpiece to position the ferrule in the workpiece hole. The part of the tool which is secured to the frame is the body 16, which comprises a pneumatic cylinder 17 in which reciprocates a nosepiece piston 18. Protruding downwards from the centre of the bottom of the nosepiece cylinder 17 is a workpiece-contacting boss 19, the lower rim 21 of which, in use, contacts the upper face 22 of the workpiece 14. Protruding upwards from the centre of the top of the cylinder 17 is an axial tubular extension 23 which acts as a piston rod. Fixed to it is a piston 24, on which reciprocates a pulling cylinder 25. The pulling cylinder is extended upwards to form a tail-jaw housing 26 which carries pneumatically operated tail jaws 27 which can grip the tail end of a mandrel. The tail jaws are actuated by a piston 28 secured to the end of a jaw-pusher tube 29 and reciprocable in a tail-jaw cylinder 30.

Figure 2:
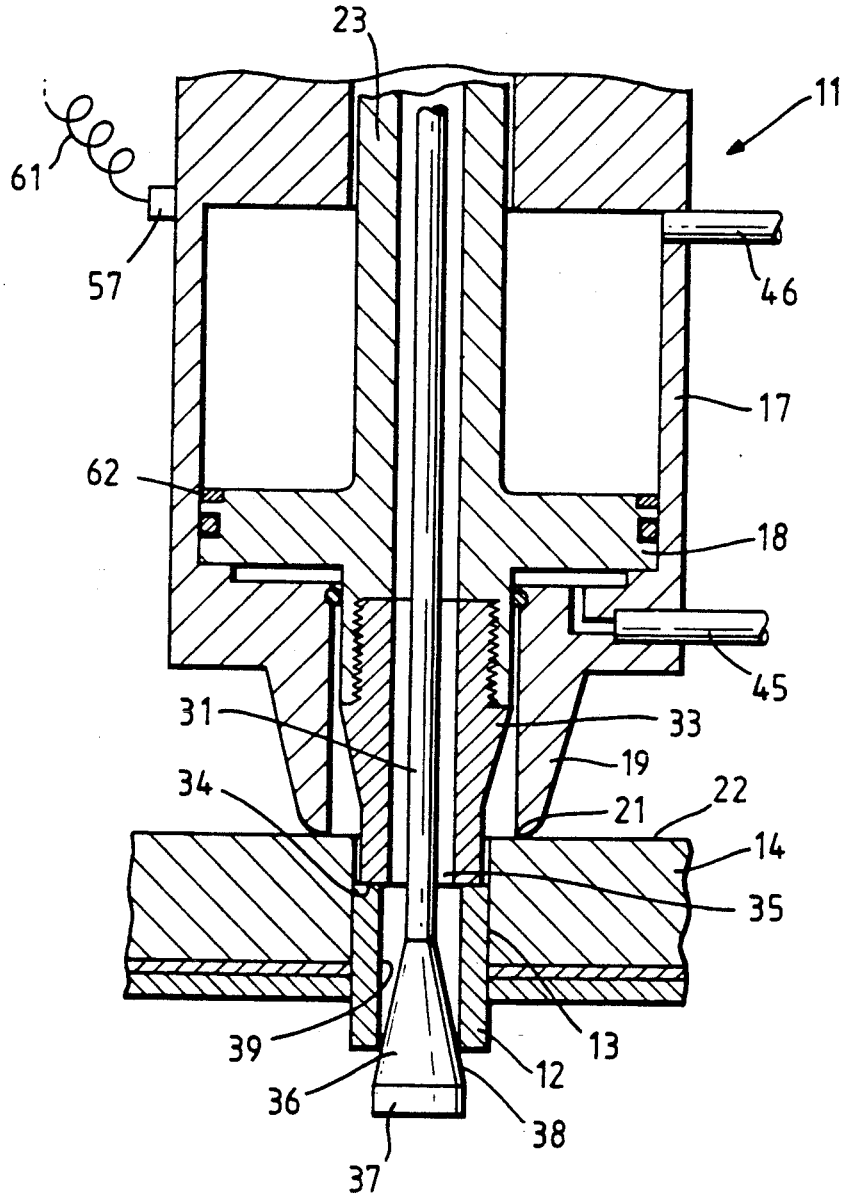
FIGS. 2, 3 and 4 are enlargements of part of FIG. 1, showing successive stages in the operation of the anvil and mandrel head in installing a ferrule.

The tail jaws 27 grip the tail end of the stem 31 of a mandrel 32. The stem extends down through an axial bore in the extension 23, through an axial bore in the nosepiece piston 18 and its downwards extension in the form of a tubular nosepiece 33 which provides at its bottom end an annular ferrule-supporting anvil 34. The nosepiece 33 and anvil 34 are not split longitudinally into a number of portions which can be moved apart to enlarge the anvil aperture, as in the prior art tools referred to previously, but are circumferentially continuous. The anvil surrounds an aperture 35 (FIG. 2) through which the mandrel stem extends. The mandrel includes an enlarged head 36 which is formed integrally with the stem 31. In this example, as illustrated in FIG. 2, the mandrel head is in the form of a short section 37 of maximum diameter, joined to the stem 31 by a relatively long, relatively shallow tapering section 38 (in this example, the included angle of the taper is about twenty five degrees). The maximum diameter of the head at section 37 is larger than the internal diameter of the bore 39 of the ferrule 12, so that when the ferrule is loaded on the mandrel stem 31 and urged against the mandrel head, the end of the ferrule stops about two thirds of the way along the mandrel head taper 38. As also illustrated in FIG. 2, the annular anvil surface 34 substantially overlies the other end face of the ferrule. In this example the outside diameter of the anvil 34 is about the same as the outside diameter of the ferrule 12, while the inside diameter of the anvil 34 (that is, the diameter of anvil aperture 35) is slightly less than the diameter of the ferrule bore 39. Thus the diameter of the mandrel head at 37 is substantially larger than the diameter of the anvil aperture 35.

As previously mentioned, the installation tool 11 is pneumatically operated. Referring again to FIG. 1, the tail cylinder 30 is double acting, and is provided with two ports 41 and 42. When the port 41 is pressurised and the port 42 is vented (as illustrated in FIG. 1), the jaw pusher 29 is urged downwards, to push the jaws 27 in to their tapered housing and urged them together to grip the tail end part of the mandrel stem 31 between them. When the port 41 is vented and the port 42 is pressurised, the jaw pusher tube 29 is pulled upwardly and releases the jaws 27, which are pushed apart by a spring and release their grip on the mandrel stem.

The main pulling cylinder 25 is also double-acting, and is provided with two ports 43 and 44. When port 43 pressurised and port 44 is vented (as illustrated in FIG. 1), the pulling cylinder 25 is urged downwards, so that the relative positions of the mandrel head 36 and anvil 34 are as illustrated in FIGS. 1 and 2. When the port 43 is vented and port 44 is pressurised, the pulling cylinder 25 is driven upwardly, carrying with it the tail jaw housing 26, tail jaws 27 and mandrel 32.

The nosepiece cylinder 17 in this example is double acting. It has a lower port 45 and an upper port 46. When port 46 is pressurised and port 45 is vented (as illustrated in FIG. 1), the nosepiece piston 18 is pushed downwardly against the lower end wall of the cylinder 17, so that the nosepiece 33 is held in a predetermined position in relation to the body 16 and the lower rim 21 of the workpiece contacting boss 19.

Figure 7:
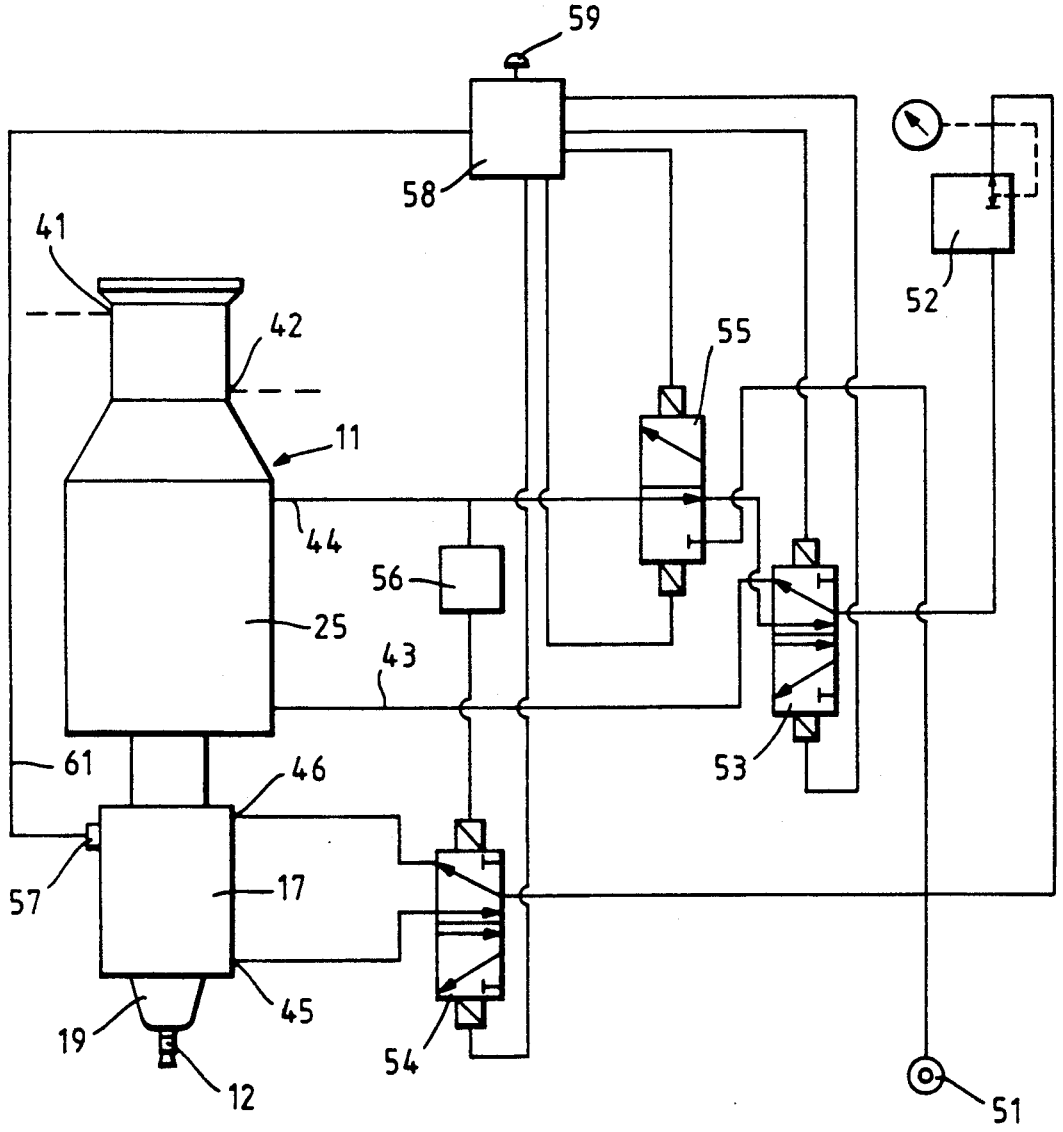
FIG. 7 is a schematic pneumatic circuit diagram of part of the control system for the installation apparatus.

FIG. 7 shows part of the pneumatic control circuit associated with the installation apparatus. All of the symbols illustrated in FIG. 7 to identify the individual pneumatic circuit elements are well known to those skilled in the pneumatic arts and the pneumatically operated tool art. Additionally, it is submitted that the construction function and operation of each of the individual elements of the pneumatic circuit illustrated in FIG. 7 are well known to those in the field of pneumatic circuit engineering. As illustrated in FIG. 7, the circuit includes an air inlet connector 51, a pressure reducing valve 52, a first change over valve 53 for controlling the pulling cylinder 25, a second changeover valve 54 for controlling the nosepiece cylinder, and a high pressure/low pressure changeover valve 55 for changing the air pressure applied to the top of pulling cylinder 25. Valve 55 has two inputs for providing air at high pressure via a direct connection from air inlet 51 to one of the inputs, and reduced pressure from the output of the pressure reduction valve 52 and changeover valve 53 to the other input. The control circuit also includes a pressure-sensitive switch 56 which is responsive to pressure input to the switch 56, and provides an electrical signal indicative thereof to associated output circuitry for outputting an electrical signal and controlling the nosepiece changeover valve 54, a position sensor 57 mounted near the upper end of nosepiece cylinder 17, and an electronic control unit 58 provided with a sequence starting switch 59. The control system also includes other elements which are not relevant to the present invention and are therefore not shown.

The pressure-sensitive switch 56 detects when the pressure applied via port 44 to the top of pulling cylinder 25 reaches a predetermined value, that is to say, when the tension applied to withdraw the mandrel head 36 through the ferrule bore reaches a predetermined value. The position sensor 57, which is a reed-switch sensitive to the proximity of an annular magnet 62 mounted on the nosepiece piston 18, detects when the nosepiece piston is in the fully raised position, that is to say when the nosepiece 33 has been fully withdrawn from the workpiece hole. Reed-switches are well known in the art as standard industrial components. The sensor 57 is connected by an electrical lead 61 to the electronic unit 58. The function and operation of a reed-switch is well known to those skilled in the art. The reed-switch 57 of the present invention is a standard industrial off-the-shelf component. Briefly, the reed-switch is an electrically conducted metal strip which is magnetized. The reed-switch forms the moving part of an electrical switch and is normally sprung into the open position, in which the electrical contact is broken. The magnetized reed is used in conjunction with a movable permanent magnet. When the permanent magnet is brought close to the reed-switch, the magnetic field of the permanent magnet interacts with the magnetized reed contact, to move the reed against its spring biasing so that it completes the electrical contact.

FIG. 1 shows the reed-switch 57 on the tool. The switch 56 is not illustrated in FIG. 1 since the switch 56 is not actually located on or near the rivet installation apparatus head which is illustrated in FIG. 1.

The tool is prepared for use to install a ferrule by removing the mandrel 32 from the tool, loading a single ferrule 12 on to the mandrel stem, and re-inserting the mandrel in the tool (this sequence of steps will be described in detail later). The various parts of the tool 11 are then disposed as illustrated in FIGS. 1 and 2. The ferrule 12 is held between the annular anvil 34 and the taper 38 on the mandrel head 36. The length of the nosepiece 33 in relation to the length of the boss 19 is pre-selected as required, as will also be described later. By moving and positioning the tool frame 15 in relation to the workpiece 14, (a common practice in the art of installing blind fasteners) the mandrel head 36, ferrule 12 and the free end of the nosepiece 33 are inserted into the workpiece hole 13, as illustrated in FIG. 2. (If the workpiece is smaller and lighter than the tool, the tool could be fixed and the workpiece would be moved towards and away from the tool). It is common practice in the art of installing blind fasteners that, depending on the relative size and weight of the workpiece and the fastener installation tool respectively, either one of them is fixed and the other is held by hand and positioned appropriately, so that either the fastener enters the workpiece hole, or, alternately, so that the workpiece receives the fastener. U.S. Pat. Nos. 4,368,838 (see column 3, lines 42–54); 3,832,880 (see column 3, lines 25–30); and 3,828,603 (see column 2, lines 50–58), are cited to illustrate the positioning technique. U.S. Pat. Nos. 4,872,332 (see column 5, lines 26–30) and 4,386,515 (see column 4, lines 33–35) are cited to illustrate the concept of moving the tool to the workpiece. The tool is positioned in relation to the workpiece 14 with the end 21 of the boss 19 contacting the nearer face 22 of the workpiece 14. In this position, the end of the nosepiece 33 is inside the workpiece hole 13 so that the annular anvil is at a predetermined distance from the nearer face 22 of the workpiece, in this example about one quarter of the length of the workpiece hole. It is held in this relationship by the pressure of the air in the space above piston 18, as described above. The remote end part of the ferrule 12 (in this example, about one quarter of the length of the ferrule) protrudes beyond the far face of the workpiece 14.

While the tool is held in this position, the condition of the various valves in the control system is illustrated in FIG. 7. The changeover valve 53 is supplying low pressure air, coming via pressure reduction valve 52, to the bottom of pulling cylinder 25, via port 43.

The installation sequence is now initiated by operating switch 59, which actuates the control unit 58 to change the valve 53. The pulling cylinder 25 is actuated, by supplying air at low pressure via port 44 to the space above piston 24 while venting the space below piston 24 via port 43. This causes the cylinder 25 to rise up the piston 24, which is fixed to the frame 15. This carries the housing 26 and jaws 27 upwards, with the jaws still gripping to the tail end of the mandrel 32. This in turn starts to draw the head 36 of the mandrel 32 upwardly into the bore 39 of the ferrule 12. The ferrule is supported against upwards axial movement by engagement of the annular anvil 34 with its upper end face. The entry of the tapered face 36 of the mandrel head causes the ferrule to expand radially, starting at its bottom end and moving progressively upwards. The lower most end part of the ferrule 12, which protrudes beyond the workpiece, is radially enlarged to form a blind head 49 (FIG. 3), which is larger in diameter than the workpiece hole and engages the rear face of the workpiece.

When the widest part 37 of the mandrel head starts to enter within the workpiece 14, the resistance to its withdrawal through the ferrule bore 39 increases, because radial enlargement of the ferrule is restricted by the wall of the workpiece hole 13. Consequently the pressure within the top part of the pulling cylinder 25 rises, increasing with the increasing tension on the mandrel stem. When the air pressure rises to a value which corresponds to sufficient mandrel tension to have ensured formation of the blind head 39 on the ferrule, the pressure sensitive switch 56 (which has been pre-adjusted to this value) closes. This causes the associated electrical circuitry to output an electrical signal to the changeover valve 54 for causing nosepiece changeover valve 54 to change its position. The pressure sensitive switch 56 has an air connection to the line feeding the port 44 and cylinder 25, and an electrical output connection to a solenoid on one end of the changeover valve 54. When the pressure input to the switch 56 is below a certain predetermined value of air pressure, no electrical output is generated. However, as set forth above, when the air pressure rises to a value which corresponds to a sufficient mandrel tension to ensure formation of the blind head 39 on the ferrule, the pressure sensitive switch 56 (which is pre-adjusted to this value) closes. This causes the associated electrical circuitry to output an electrical signal which causes the nosepiece changeover valve 54 to change. The pressure sensitive switch 56 itself is well known to those skilled in the art.

This vents the port 46 and pressurises the port 45 with high pressure air from the connector 51. The nosepiece piston 18 rises quickly, so that the nosepiece 33 is withdrawn upwards, out of contact with the ferrule, and out of the workpiece hole 13.

Figure 4:
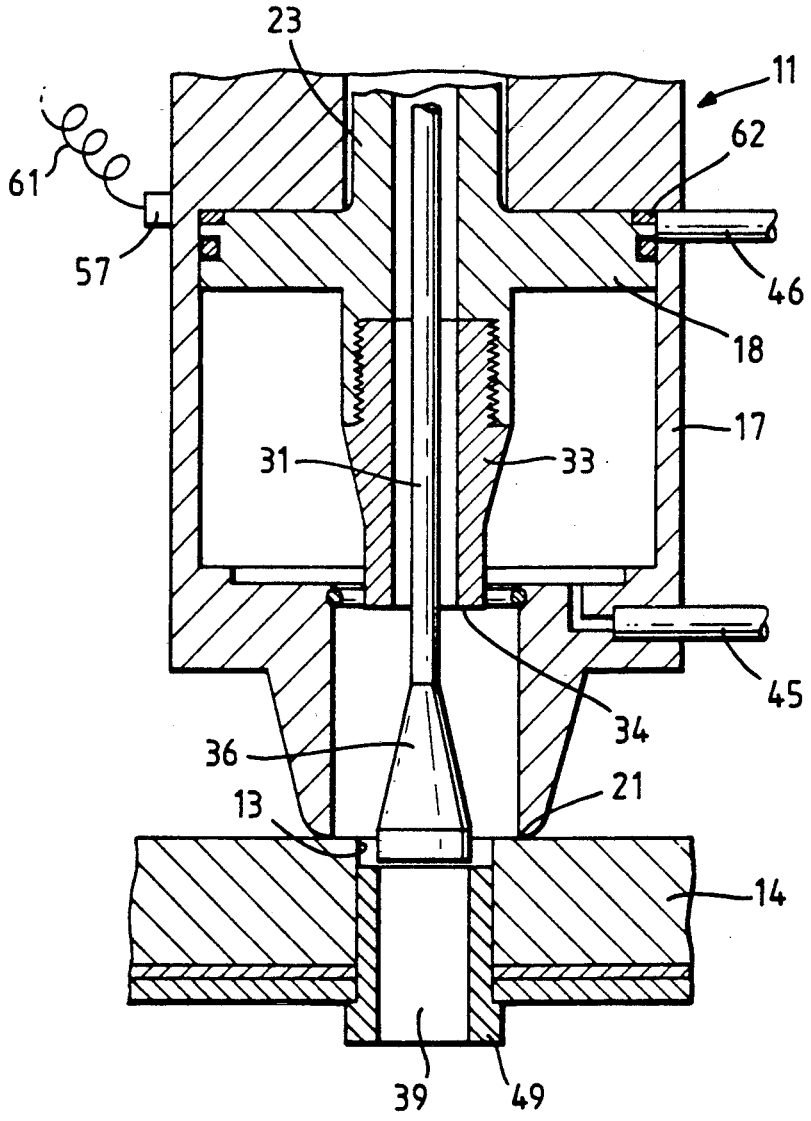

When the nosepiece piston 18 reaches the top of its travel, this is detected by the proximity sensor 57. This sends an electrical signal (indicating that the nosepiece 33 has been completely withdrawn) to the electronic control unit 58. In response to this the control unit generates an electrical output signal, which causes the high/low pressure changeover valve 55 to change. This changes the feed to the upper part of the pulling cylinder 25, from low pressure (from pressure reduction valve 52) to high pressure (from inlet connector 51). The changeover valve 55 has two inputs, one at a high pressure via a direct connection from air inlet connector 51, and the other at reduced pressure from the output of pressure reduction valve 52 and connection via changeover valve 53 when the changeover valve 53 is reversed from the position illustrated in FIG. 7. This substantially increases the withdrawal force applied to the mandrel 31. The mandrel head 36 moves further upwards, through the remainder of the ferrule bore, expanding the ferrule radially outwards into engagement with the wall of the workpiece hole. The engagement between the mandrel head 36 and the wall of the ferrule bore 39 tends to drag the ferrule upwards with the mandrel head, but movement of the ferrule is resisted by the abutment of the blind head 49, which has been formed first, with the rear face of the workpiece. The mandrel continues to move upwards, until its head has been drawn completely through the ferrule bore, as illustrated in FIG. 4, thus installing the ferrule in the workpiece. The workpiece 14 is now removed from contact with the rim 21, and the mandrel 32 and anvil 34 returned to their original position by reversing the cylinder 25, i.e. by venting the port 44 and pressurising the port 43 with low pressure air, and thus reversing the piston 18.

When the mandrel head 36 is pulled through the ferrule, it squeezes the ferrule radially outwardly against the workpiece hole wall, and causes a reduction in thickness of the ferrule wall. This has the effect of causing an axial elongation of the ferrule, which is apparent from a comparison of the relative positions of the upper end of the ferrule in FIG. 2 (before installation) and FIG. 4 (after installation).

As already set forth, the standard conventional symbols used in the pneumatic circuit diagram of FIG. 7 indicate that the changeover valve 55, like the valves 53 and 54, are solenoid controlled. The electronic control unit 58 is connected to both of the solenoids of the changeover valve 55, as indicated in FIG. 7. As already described, when the control unit 58 generates an electrical output signal, this causes the changeover valve 55 to change, since both solenoids are actuated and therefore move the valve. The above function and operation of the valves are well known to those skilled in the art.

The withdrawal force on the mandrel 31 is substantially increased when the valve 55 changes over, because, as previously described, the changeover action of the valve 55 replaces the low pressure air supplied to the upper part of the pulling piston 25 by a high pressure air supply. Since, as is well known, the force on a surface is the surface area multiplied by the pressure applied to that surface, increase in the air pressure within the cylinder produces an increase on the force exerted on the cylinder.

Figure 3:
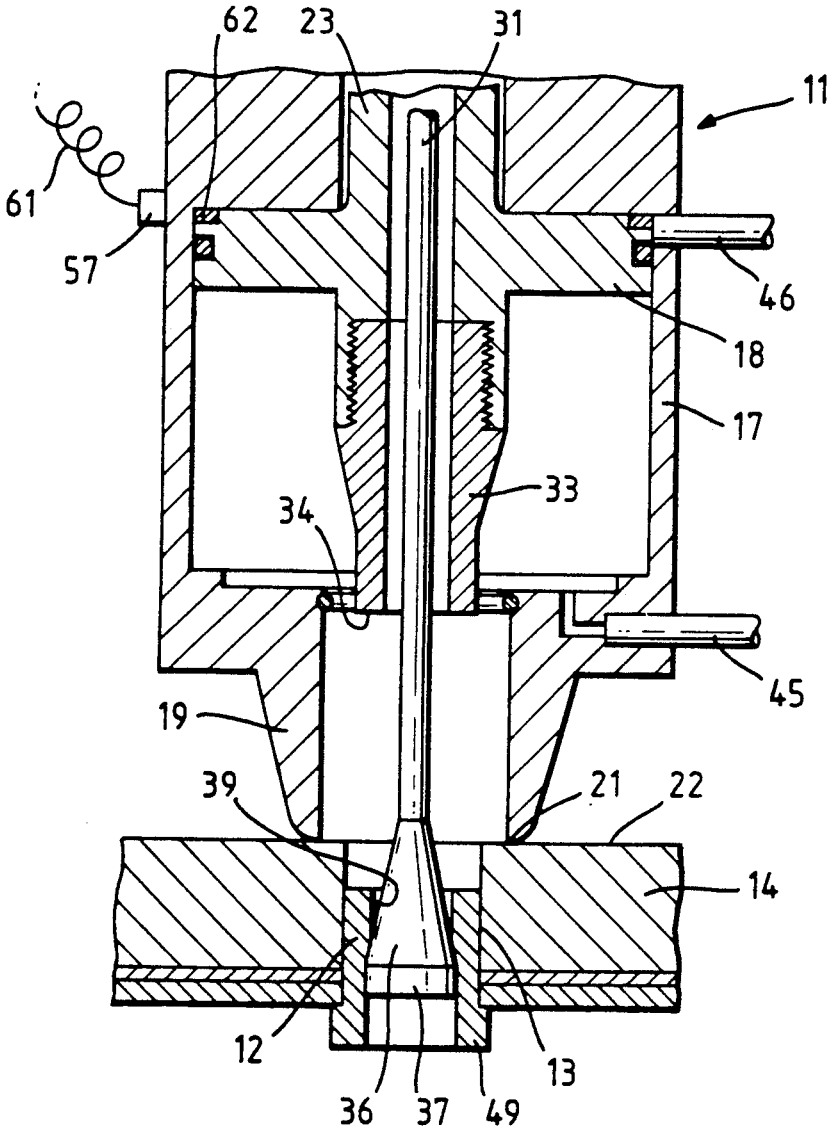

The engagement of the mandrel head 36 and the wall of the ferrule bore is due to an interference fit of the head with the bore. As already stated, the maximum diameter of the head of the section 37 is larger than the internal diameter of the bore 39 of the ferrule 12. Additionally, as already described, when the widest part 37 of the mandrel head starts to enter within the workpiece 14, the resistance to its withdrawal through the ferrule bore 39 increases, because radial enlargement of the ferrule is restricted by the wall of the workpiece hole 13. This is also illustrated in FIG. 3 which illustrates that the tapered mandrel head 36 is wedged in the bore 39 of the ferrule, which is narrower above the mandrel head. This engagement between the mandrel head 36 and the wall of the ferrule bore 39 tends to drive the ferrule upwards with the mandrel head.

In the present example, the installation apparatus and the method using it are arranged to fulfill a requirement that the upper end of the ferrule 12, after installation, is at a first predetermined distance below the upper face 22 of the workpiece 14. This is achieved by arranging the initial position of the anvil, and thus the initial position of the upper end of the ferrule, to be at a second predetermined distance below the upper face of the workpiece. The second predetermined distance is greater than the first predetermined distance by an amount equal to the increase in length of the ferrule on installation.

The ferrule thus having been installed in a workpiece, it is now necessary to reload a further ferrule on to the mandrel, ready for installation. This is done as follows.

Figure 5:
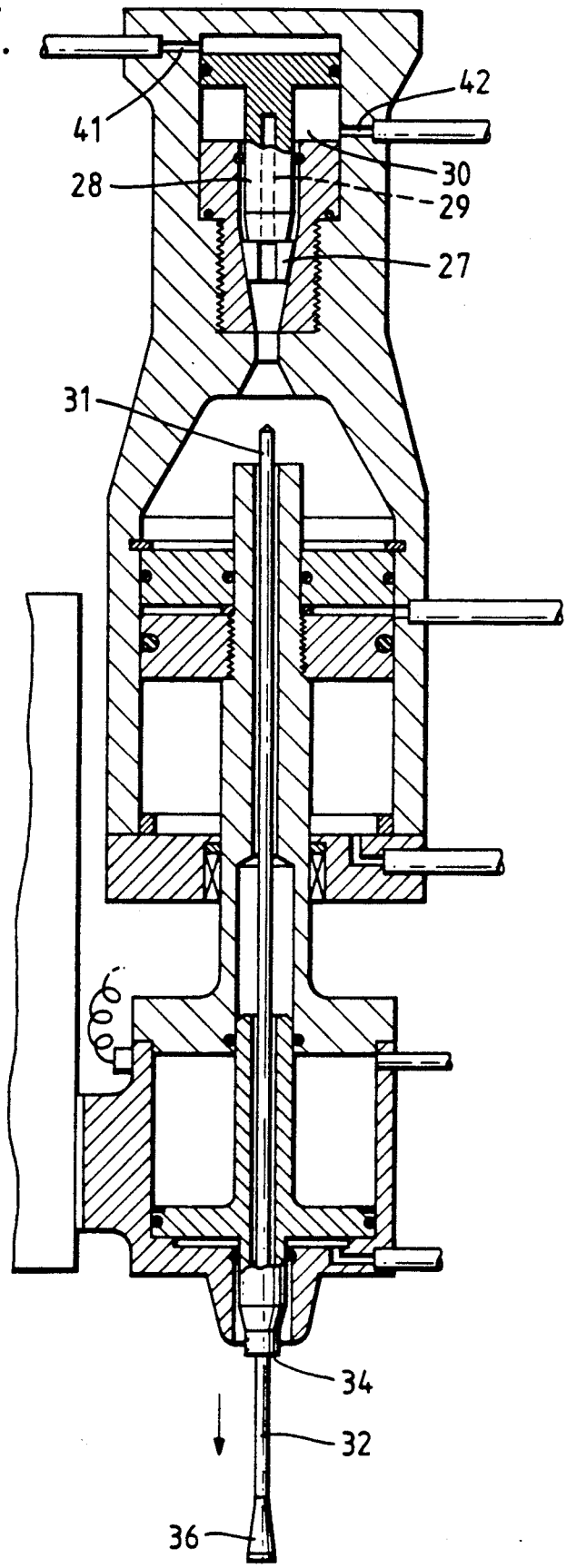
FIGS. 5 and 6 show how the mandrel is withdrawn from the rest of the apparatus for reloading with a further ferrule, and re-inserted in the apparatus.

The tool is moved clear of the workpiece (or, as mentioned previously, the workpiece is moved clear of the tool). The grip of the tool on the mandrel 32 is released by venting the port 41 of the tail jaw cylinder 30 and pressurising the port 42. This moves the piston 28 and tail jaw pusher 29 upwards, releasing the force on the tail jaws 27 and allowing them to move apart under the urging of a spring (not shown), thus releasing their grip on the mandrel. The empty mandrel 32 can then be withdrawn downwardly from the tool, through the anvil aperture 34, as illustrated in FIG. 5.

Figure 6:
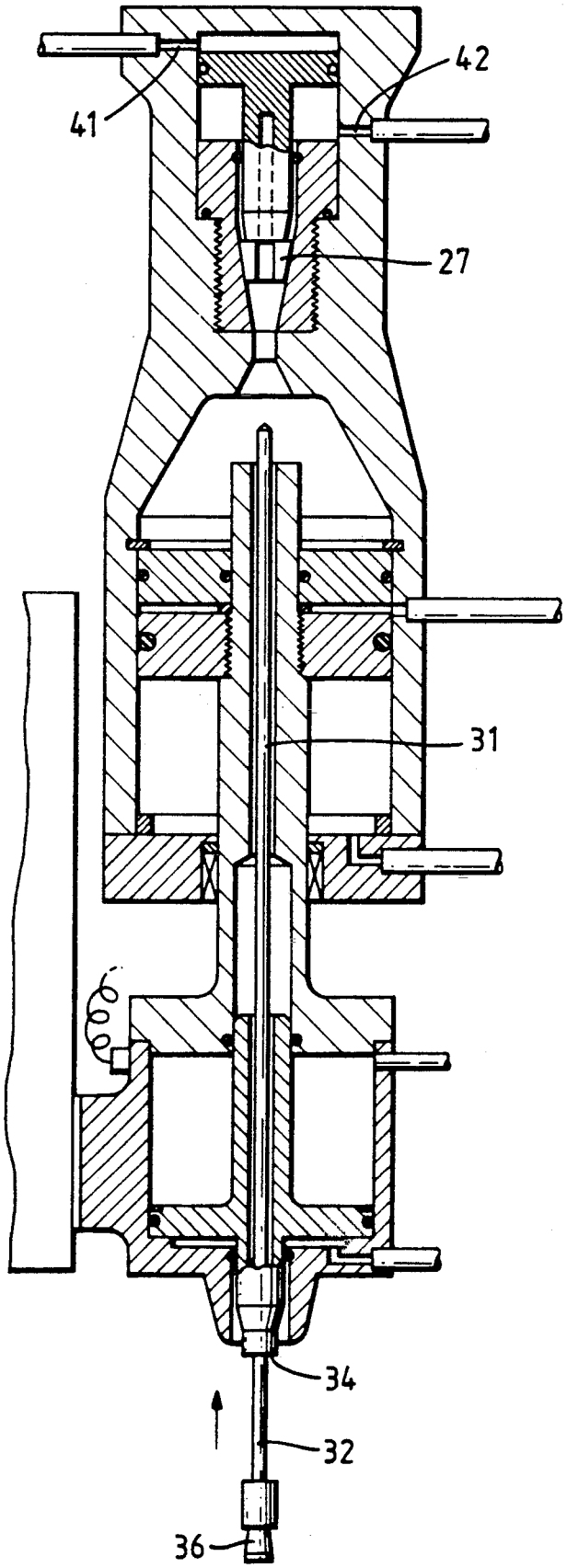

A further ferrule 12 can then be loaded on to the mandrel 32 over the tail end of the stem 31, as illustrated in FIG. 6. It is passed along the mandrel stem until it contacts the tapered face 38 of the mandrel head 36. The mandrel is then re-inserted through the anvil aperture 34. The mandrel is inserted into the tool until the mandrel head 36 traps the ferrule 12 against the anvil 34. The mandrel is then re-engaged by closing the tail jaws 27 to grip it, by venting the port 42 and pressurising the port 41. The tool is then ready to instal the further ferrule 12.

Figure 8:
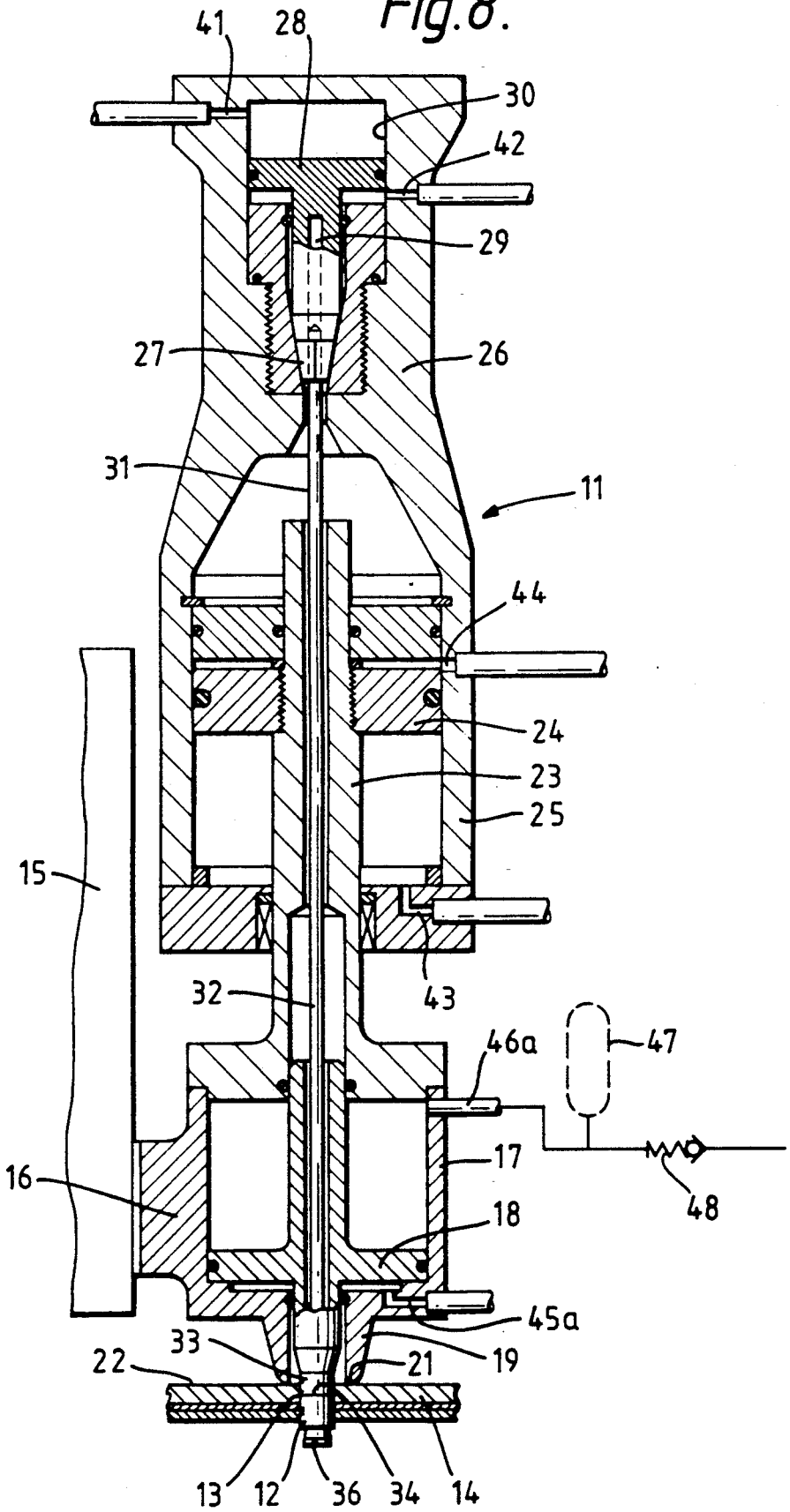
FIG. 8 is similar to FIG. 1 but shows an alternative arrangement for withdrawing the anvil.

FIG. 8 illustrates a modification of the tool illustrated in FIG. 1. In the modified tool, the nosepiece piston 18 is not advanced and retracted positively, but instead is advanced by resilient urging of an air spring. The inlet port 46A is connected to a pneumatic accumulator 47 and is fed through a non-return restrictor valve 48 (both shown symbolically in FIG. 8). The effect of the pneumatic accumulator 47 is to act as a pneumatic spring which resiliently urges downwards the nosepiece piston 18 into the aforesaid predetermined relationship with the body 16 and the lower rim 21 of the boss 19.

When the mandrel is withdrawn upwardly, the narrow end of the tapered part 38 of the mandrel head then enters into the anvil aperture 35, until the tapered part of the mandrel head engages the anvil 34. The upward force on the mandrel head 36, due to the air pressure in the top part of pulling cylinder 25, is greater than the downwards force on the nosepiece 33 due to the resilient urging of the air pressure in cylinder 17 above the nosepiece piston 18. Consequently the upwardly moving mandrel head 36 picks up the nosepiece 33 and the nosepiece travels upwards with the mandrel head.

However, it is believed that the positive prior withdrawal of the nosepiece, without contact by the mandrel head, is preferable, since repeated contact could cause wear to the nosepiece. In the example illustrated in FIG. 1, the stroke of the nosepiece piston 18 is greater than the stroke of the pulling cylinder 25, so that once the nosepiece has been fully withdrawn the mandrel head cannot contact it.

The invention is not restricted to the details of the foregoing example. For instance it will be apparent to those skiled in the art of pneumatic systems that the control system can incorporate other features which have not been described above.

We claim:

1. An apparatus for the pull-through blind installation of a tubular member, in a hole in a workpiece which has a nearer face into which the hole opens, said installation of the tubular member being at a position along the hole spaced away from said nearer face of the workpiece, which apparatus comprises:

cylinder means having a reciprocating piston therein, said reciprocating piston having a portion extending forwardly towards the workpiece with a bore extending through said piston and forwardly extending portion, said forwardly extending portion of the piston having an annular anvil with an aperture of a fixed predetermined size which is aligned with the bore of the piston and the forwardly extending portion of the piston, said annular anvil abutting against an end surface of a tubular member positioned inside the workpiece hole for supporting said tubular member inside said workpiece hole;

a mandrel having an enlarged head positioned beyond a bore of the tubular member, and a stem extending from the enlarged head through the bore of the tubular member, through the anvil aperture, and through the bore of the piston and forwardly extending portion of the piston, the mandrel head having a fixed size which is greater than the predetermined size of the anvil aperture such that the mandrel head cannot pass through the anvil aperture;

retraction means comprising means for grabbing an end portion of said mandrel stem and applying a retraction force for retracting the stem in a direction away from the anvil aperture to thereby apply a withdrawal load to the enlarged head of the mandrel so as to draw the mandrel head into the bore of the tubular member while the annular anvil and reciprocating piston are abutting against and supporting the tubular member inside the workpiece hole, to thereby enlarge at least part of the tubular member more remote from the anvil into engagement with the workpiece; and means for withdrawing the annular anvil away from the tubular member to allow the mandrel head to be withdrawn completely through and out of the remainder of the bore of the tubular member.

2. Apparatus as claimed in claim 1, including control means comprising means for detecting when the retraction force applied to the mandrel reaches a predetermined value indicative of the blind installation of the tubular member in the workpiece hole, the detecting means sending a signal to said means for withdrawing the anvil away from the tubular member for initiating withdrawal of the anvil.

3. Apparatus as claimed in claim 2, wherein said control means further comprises means for increasing the force applied to the mandrel for drawing the mandrel head through the remainder of the bore of the tubular member, after the annular anvil has been withdrawn from the bore of the tubular member.

4. Apparatus as claimed in claim 3, wherein said control means comprises means for detecting when the annular anvil has been withdrawn from the tubular member sufficiently to allow the mandrel head to be withdrawn completely out of the bore of the tubular member, the anvil withdrawal detecting means being operatively connected to said means for increasing the force to thereby initiate the increase of force applied to the mandrel.

5. Apparatus as claimed in claim 1, wherein said means for withdrawing the anvil away from the tubular member comprises the mandrel head.

6. Apparatus as claimed in claim 1, wherein said cylinder means comprises workpiece-contacting means, in which the annular anvil and forwardly extending portion of the piston are disposed in a first predetermined position in relation to the workpiece-contacting means, such that when the workpiece-contacting means is in contact with the workpiece, the annular anvil is located inside the workpiece hole so as to abut against and support the tubular member inside the workpiece hole.

7. An apparatus for the pull-through blind installation of a tubular member, in a hole in a workpiece which has a nearer face into which the hole opens, said installation of the tubular member being at a position along the hole spaced away from said nearer face of the workpiece, which apparatus comprises:

cylinder means having a reciprocating piston therein, said reciprocating piston having a portion extending forwardly towards the workpiece with a bore extending through said piston and forwardly extending portion, said forwardly extending portion of the piston having an annular anvil with an aperture of a predetermined size which is aligned with the bore of the piston and the forwardly extending portion of the piston, said annular anvil abutting against a tubular member positioned inside the workpiece hole for supporting said tubular member inside said workpiece hole;

a mandrel having an enlarged head positioned beyond a bore of the tubular member, and a stem extending from the enlarged head through the bore of the tubular member, through the anvil aperture, and through the bore of the piston and forwardly extending portion of the piston, the mandrel head having a fixed size which is greater than the predetermined size of the anvil aperture such that the mandrel head cannot pass through the anvil aperture;

retraction means comprising means for grabbing an end portion of said mandrel stem and applying a retraction force for retracting the stem in a direction away from the anvil aperture to thereby apply a withdrawal load to the enlarged head of the mandrel so as to draw the mandrel head into the bore of the tubular member while the annular anvil and reciprocating piston are abutting against and supporting the tubular member inside the workpiece hole, to thereby enlarge at least part of the tubular member more remote from the anvil into engagement with the workpiece;

means for withdrawing the annular anvil away from the tubular member to allow the mandrel head to be withdrawn completely through and out of the remainder of the bore of the tubular member; and control means comprising means for detecting when the retraction force applied to the mandrel reaches a predetermined value indicative of the blind installation of the tubular member in the workpiece hole, the detecting means sending a signal to said means for withdrawing the anvil away from the tubular member for initiating withdrawal of the anvil;

wherein said control means further comprises means for increasing the force applied to the mandrel for drawing the mandrel head through the remainder of the bore of the tubular member, after the annular anvil has been withdrawn from the bore of the tubular member, and means for detecting when the annular anvil has been withdrawn from the tubular member sufficiently to allow the mandrel head to be withdrawn completely out of the bore of the tubular member, the anvil withdrawal detecting means being operatively connected to said means for increasing the force to thereby initiate the increase of force applied to the mandrel.

* * * * *